US006752693B1

(12) United States Patent
Kistler

(10) Patent No.: US 6,752,693 B1
(45) Date of Patent: Jun. 22, 2004

(54) AFFERENT-BASED POLISHING MEDIA FOR CHEMICAL MECHANICAL PLANARIZATION

(75) Inventor: Rodney C. Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/206,749

(22) Filed: Jul. 26, 2002

(51) Int. Cl.[7] ..... B24B 49/00; B24B 51/00

(52) U.S. Cl. ..... 451/8; 451/288; 451/550; 451/59

(58) Field of Search ..... 451/5, 8, 9, 10, 451/11, 41, 59, 63, 285–290, 533, 550; 216/88, 89; 438/692, 693; 156/344, 345.1, 345.12, 345.13, 345.15, 345.16, 345.24

(56) References Cited

U.S. PATENT DOCUMENTS 5,762,536 A * 6/1998 Pant et al. ..... 451/6
5,868,896 A * 2/1999 Robinson et al. ..... 156/344
5,944,580 A * 8/1999 Kim et al. ..... 451/9
6,143,123 A * 11/2000 Robinson et al. ..... 156/344
6,363,183 B1 * 3/2002 Koh ..... 385/19
6,458,015 B1 * 10/2002 Robinson et al. ..... 451/11
6,488,569 B1 * 12/2002 Wang et al. ..... 451/8
6,520,834 B1 * 2/2003 Marshall ..... 451/5

FOREIGN PATENT DOCUMENTS

JP 06196456 A * 7/1994 ..... H01L/21/304
JP 11048125 A * 2/1999 ..... B24B/37/00

* cited by examiner

*Primary Examiner*—Joseph J. Hail, III
*Assistant Examiner*—David B. Thomas
(74) *Attorney, Agent, or Firm*—Martine & Penilla, LLP

(57) ABSTRACT

One polishing media for chemical mechanical planarization includes an underlayer and a plurality of pressure sensors provided on the underlayer. At least some of the pressure sensors have a pad asperity provided thereon. The pressure sensors may be micro electromechanical systems (MEMS) pressure transducers or MEMS thermal actuators that monitor at least one of localized strain and temperature variation. Another polishing media includes a plurality of chemical sensors. Yet another polishing media includes pressure sensors, chemical sensors, and piezoelectric elements. Based upon the sensory outputs received from adjacent sensors, the piezoelectric elements provide active control to the process input by, for example, inducing localized vibration to modify the spatial removal behavior, inducing localized electric fields, or inducing localized heating/cooling elements.

12 Claims, 7 Drawing Sheets

Embedded Chemical Sensor
106'b
106'a
106'd
100
102
103
104
Pad
106'

AFFERENT-BASED POLISHING MEDIA FOR CHEMICAL MECHANICAL PLANARIZATION

BACKGROUND OF THE INVENTION

The present invention relates to semiconductor fabrication and, more particularly, to an afferent polishing media for chemical mechanical planarization ("CMP").

In the fabrication of semiconductor devices, CMP is used to planarize globally the surface of an entire semiconductor wafer. CMP is often used to planarize dielectric layers as well as metallization layers. As is well known to those skilled in the art, in a CMP operation a wafer is rotated under pressure against a polishing pad in the presence of a slurry.

During a CMP operation, the film removal process is typically controlled by either timing the operation or using a variety of endpoint techniques to determine the end of the process-cycle. These control techniques are typically deployed with the wafer pressed face down into a polishing pad and thereby obscuring the majority of the wafer surface from viewing using conventional methods. Thus, one drawback of the control techniques currently used in CMP operations is that they fail to provide sufficient spatial recognition of both wafer-level and die-level topography changes. This leads to poor within-wafer (WIW) film removal process control.

In view of the foregoing, there is a need for a polishing media that provides enhanced spatial insight to die-level and wafer-level planarization characteristics in real time and thereby enables active WIW film removal process control during a CMP operation.

SUMMARY OF THE INVENTION

Broadly speaking, the present invention fills this need by providing an afferentbased polishing media for chemical mechanical planarization (CMP) that includes sensors for providing information regarding the process evolution across the wafer substrate during the CMP operation. As used herein, the term "afferent-based" is meant to generally define the process by which impulses are conducted from the periphery of the pad media body (e.g., asperities) to a central control, such as a computer control station.

In accordance with one aspect of the present invention, a first polishing media for CMP is provided. This polishing media includes an underlayer and a plurality of pressure sensors provided on the underlayer. At least some of the pressure sensors have a pad asperity provided thereon. In one embodiment, the pressure sensors are micro electromechanical systems (MEMS) pressure transducers. In another embodiment, the pressure sensors are MEMS thermal actuators that monitor at least one of localized strain and temperature variation.

In one embodiment, the pad asperities are comprised of one of a urethane-based material, an engineered plastic material, a ceramic material, and magnetic fluids. These materials, and other well know in the manufacture of MEMS can be used to provide localized asperity bulk-property control. In one embodiment, the polishing media includes wiring for providing sensory communication to a system control. In one embodiment, the underlayer is formed in discrete sections.

In accordance with another aspect of the present invention, a second polishing media for CMP is provided. This polishing media includes an underlayer having a plurality of pad asperities and a plurality of chemical sensors affixed to the underlayer. In one embodiment, the chemical sensors are embedded in the underlayer. In one embodiment, at least some of the chemical sensors are configured to detect metal ions selected from the group consisting of Cu, Ta, Ti, Al, W, and Pb. In one embodiment, at least some of the chemical sensors are configured to detect organic species. In one embodiment, at least some of the chemical sensors are configured to detect inorganic species.

In accordance with a further aspect of the present invention, a third polishing media for CMP is provided. This polishing media includes an underlayer. A plurality of pressure sensors are provided on the underlayer, with at least some of the pressure sensors having a pad asperity provided thereon. A plurality of chemical sensors and a plurality of piezoelectric elements also are provided on the underlayer. Each of the piezoelectric elements is coupled to at least one of an adjacent pressure sensor and an adjacent chemical sensor.

In one embodiment, at least some of the piezoelectric elements provide localized pressure in either a static or dynamic mode. In one embodiment, at least some of the piezoelectric elements induce localized electric fields to increase chemical dissolution rates and or change the hardness of the pad-asperity in contact with the wafer substrate. In one embodiment, at least some of the piezoelectric elements induce localized heating/cooling elements to change the chemical reactivity of the slurry chemistry and or change the hardness of the pad-asperity. In one embodiment, at least some of the piezoelectric elements have a pad asperity provided thereon.

It is to be understood that the foregoing general description and the following detailed description are exemplary and explanatory only, and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF EXEMPLARY EMBODIMENTS

Several exemplary embodiments of the invention will now be described in detail with reference to the accompanying drawings.

Figure 1A:
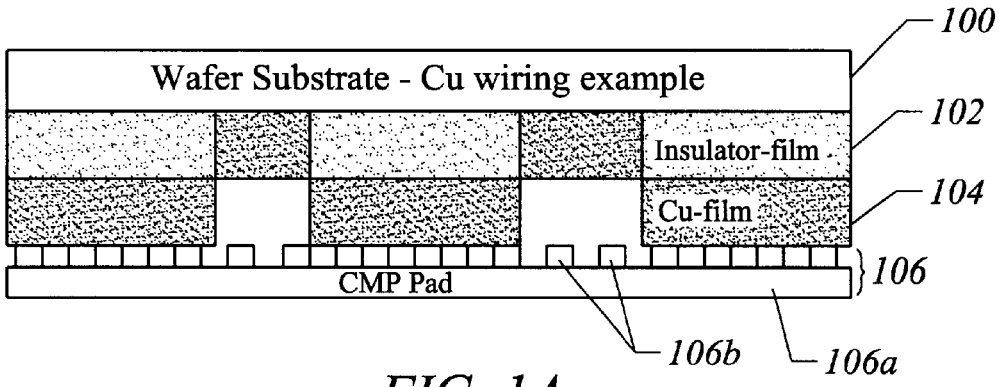
FIGS. 1A to 1C illustrate an exemplary chemical mechanical planarization (CMP) operation using a polishing media provided with pressure sensors in accordance with one embodiment of the present invention.
Figure 1B:
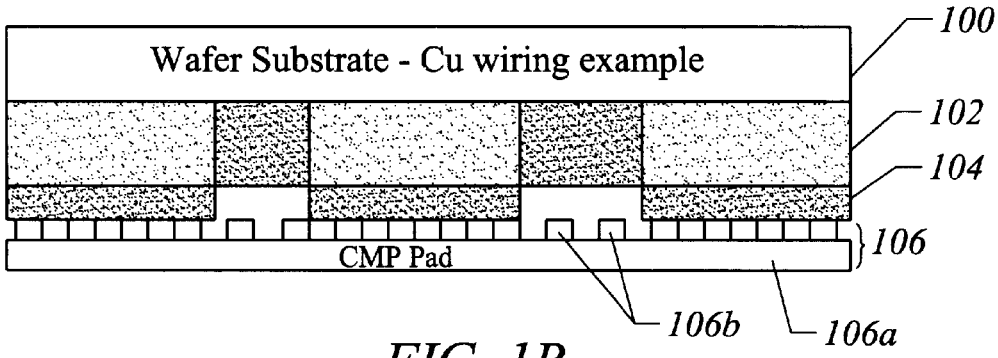
Figure 1C:
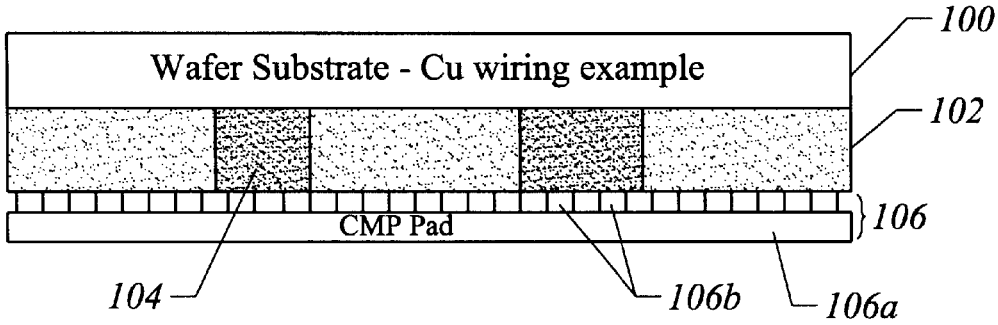

FIGS. 1A to 1C illustrate an exemplary chemical mechanical planarization (CMP) operation using a polishing media provided with pressure sensors in accordance with one embodiment of the invention. FIG. 1A shows the wafer substrate in contact with the polishing media just before the start of the CMP operation. As shown in FIG. 1A, wafer substrate 100 has a patterned insulator film 102 and a deposited copper (Cu) film 104 formed thereon. Polishing pad 106 includes underlayer 106*a,* which has pad asperities 106*b* disposed thereon. As a result of the wafer topography, only some of the pad asperities 106*b* are in contact with copper film 104. FIG. 1B shows the wafer substrate in contact with the polishing media during the CMP operation. As shown in FIG. 1B, a portion of copper film 104 has been removed; however, still only some of the pad asperities 106*b* are in contact with the copper film. FIG. 1C shows the wafer substrate at the end of the CMP operation when the wafer topography has been removed. As shown in FIG. 1C, all of the excess copper film 104 has been removed and full contact between all of the pad asperities 106*b* and the top surfaces of insulator film 102 and copper film 104 has been achieved.

Figures 2A, 2B:
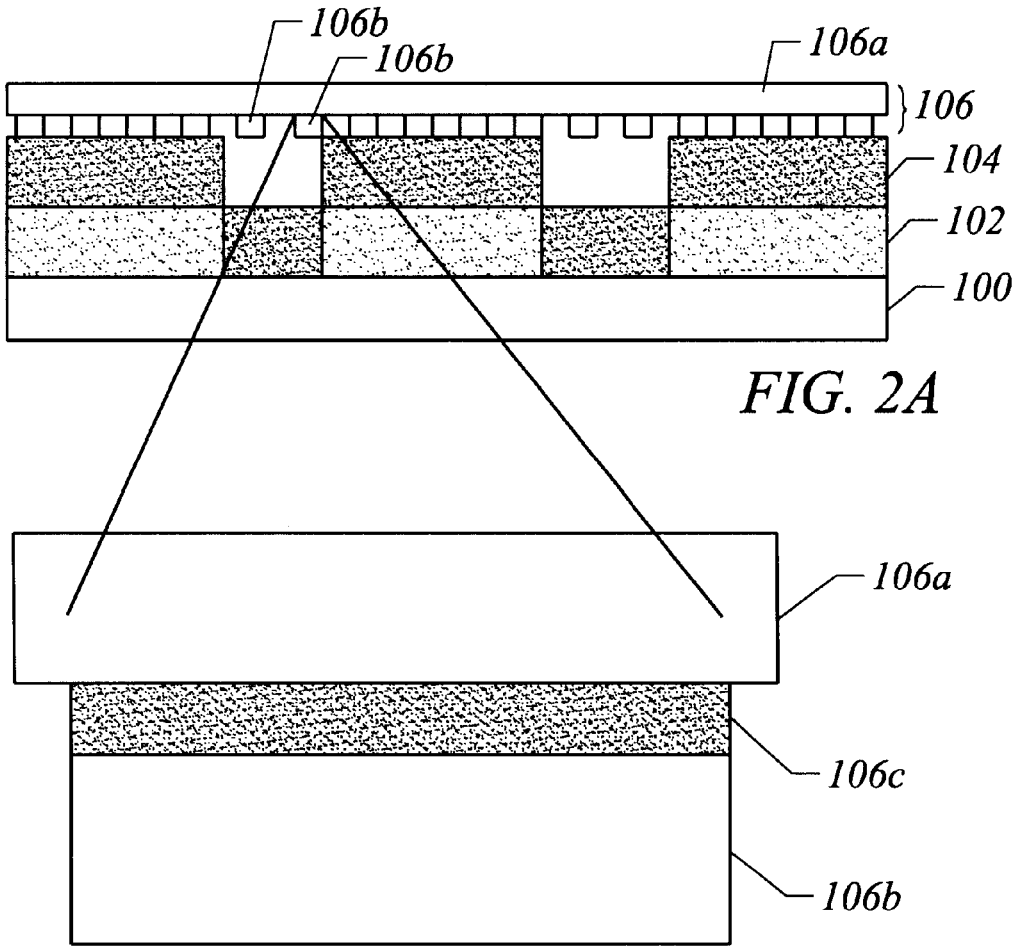
FIGS. 2A and 2B show the structure of a polishing media provided with pressure sensors in accordance with one embodiment of the present invention, with FIG. 2B being an enlarged view of the portion of the polishing media indicated in FIG. 2A.

FIGS. 2A and 2B show the structure of a polishing media provided with pressure sensors in accordance with one embodiment of the invention, with FIG. 2B being an enlarged view of the portion of the polishing media indicated in FIG. 2A. As shown in FIG. 2B, pressure sensor 106*c* is provided between pad asperity 106*b* and underlayer 106*a*. In one embodiment, pressure sensor 106*c* is a micro electromechanical systems (MEMS) pressure transducer. Those skilled in the art are familiar with the structure and operation of MEMS pressure transducers. In another embodiment, pressure sensor 106*c* is a MEMS thermal actuator that monitors localized strain or temperature variation. Those skilled in the art are also familiar with the structure and operation of MEMS thermal actuators. The size of the MEMS sensors may be selected to provide spatial recognition of die-level and wafer-scale topography changes. In one embodiment, the size of the MEMS sensors is 0.5 mm per side.

During a CMP operation, the feedback received from pressure sensors 106*c* indicates the localized pressure applied to the wafer substrate during the planarization process. As areas of protruding topography (high areas) will have greater localized pressure applied relative to areas of recessed topography (low areas), the pressure sensors 106*c* will provide specific information regarding the distribution of pressure across a given die or wafer. This information can be used in a process control scheme to call the end point of the CMP operation. By way of example, the end point may be called when all pad asperities 106*b* are in contact with the planarized surface, i.e., the top surfaces of insulator film 102 and copper film 104 as shown in FIG. 1C. The localized pressure information also can be used to provide real-time feedback to the tool control system to adjust process parameters to compensate for observed planarization non-uniformities.

Figure 3:
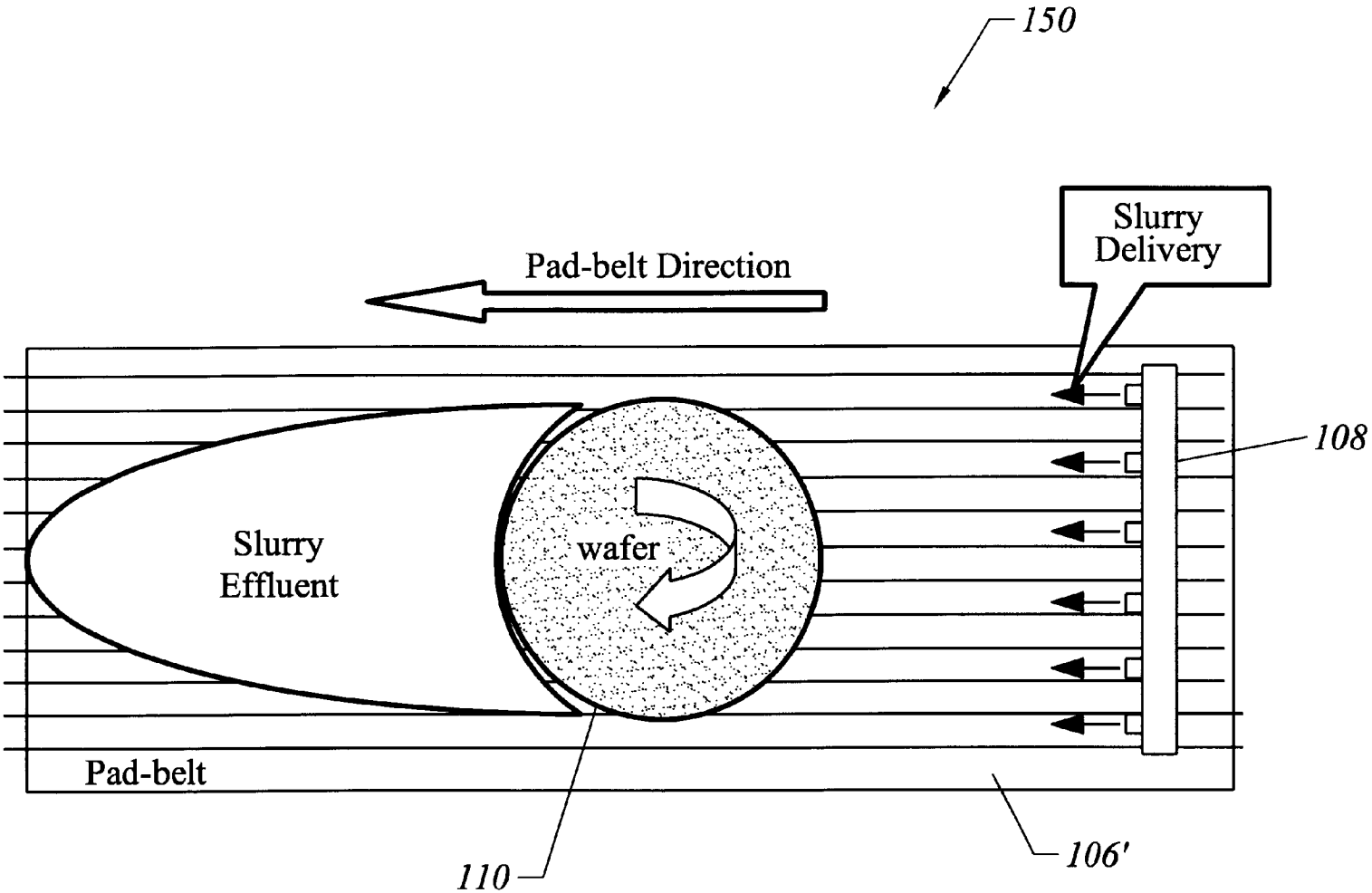
FIG. 3 is a simplified top view of a linear CMP system including a polishing media provided with chemical sensors in accordance with one embodiment of the present invention.

In addition to pressure sensors, the polishing media also may be provided with chemical sensors to monitor, e.g., the slurry effluent. FIG. 3 is a simplified top view of a linear CMP system including a polishing media provided with chemical sensors in accordance with one embodiment of the invention. As shown in FIG. 3, linear CMP system 150 includes slurry manifold 108, which has nozzles for delivering slurry onto pad-belt 106'. As is well known to those skilled in the art, pad-belt 106' rotates in the direction indicated by the straight arrow and carries the slurry to wafer 110, which rotates in the direction indicated by the curved arrow. It will be apparent to those skilled in the art that the polishing head that is typically used to support and rotate the wafer has been omitted from FIG. 3. Pad-belt 106' is provided with chemical sensors, as described in more detail below with reference to FIGS. 4A and 4B. The chemical sensors monitor the slurry effluent, which is generated by the reaction that takes place when the slurry chemistry contacts the surface of wafer 110. It will be apparent to those skilled in the art that slurry chemistry may or may not contain abrasive particles.

By measuring the concentration of a material/chemical species in the slurry effluent, precise information regarding the substrate materials being removed and their respective rate of material removal during a CMP operation can be obtained. In addition, precise information regarding the onset of new material interfaces can be obtained. For one example, in shallow trench isolation (STI) applications, the transition from $SiO_2$ to $Si_3N_4$ can be precisely detected. For another example, in copper applications, the transition from Cu to Ta (barrier-film) can be precisely detected.

Figures 1, 2, 4A, 4B:
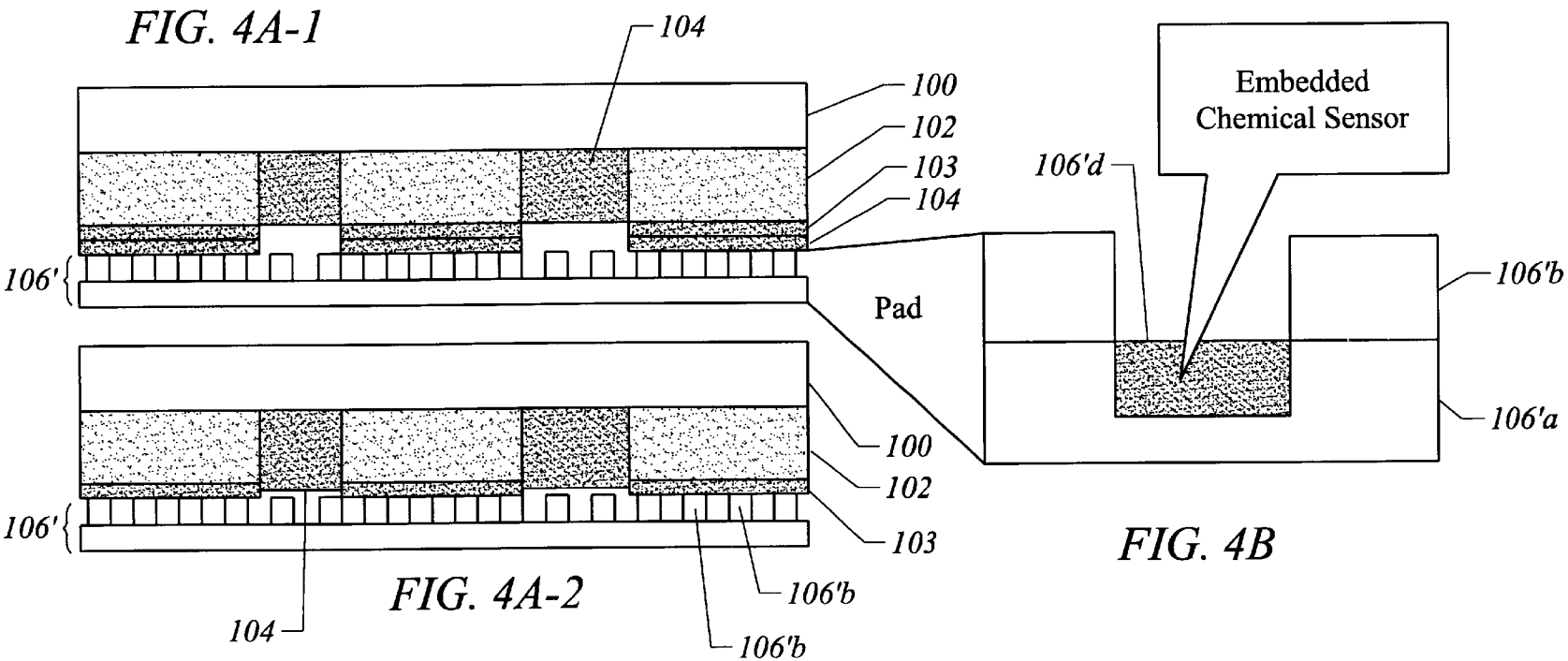
FIGS. 4A-1 and 4A-2 illustrate an exemplary CMP operation using a polishing media provided with chemical sensors in accordance with one embodiment of the present invention.
FIG. 4B is an enlarged view of the portion of the polishing pad indicated in FIG. 4A-1 that shows the structure of a polishing media provided with chemical sensors in accordance with one embodiment of the present invention.

FIGS. 4A-1 and 4A-2 illustrate an exemplary CMP operation using a polishing media provided with chemical sensors in accordance with one embodiment of the present invention. FIG. 4A-1 shows the wafer substrate in contact with the polishing media during the CMP operation. As shown in FIG. 4A-1, polishing pad 106' has removed a portion of the excess copper film 104 formed on tantalum (Ta) film 103. FIG. 4A-2 shows the wafer substrate in contact with the polishing media at the end of the CMP operation. As shown in FIG. 4A-2, all of the excess copper film 104 has been removed and some of the pad asperities 106'*b* are in contact with tantalum film 103.

FIG. 4B, which is an enlarged view of the portion of the polishing pad 106' indicated in FIG. 4A-1, shows the structure of a polishing media provided with chemical sensors in accordance with one embodiment of the present invention. As shown in FIG. 4B, chemical sensor 106'*d* is embedded in underlayer 106'*a* between pad asperities 106'*b*. In one embodiment, chemical sensor 106'*d* includes a liquid chromatography (LC) separator for sub-ppb level detection. In another embodiment, chemical sensor 106'*d* is a multi-element array sensor that uses electrochemical analyses for the detection of metal ions such as, for example, Cu, Ta, Ti, Al, W, and Pb. In yet another embodiment, chemical sensor 106'*d* is an electrode sensor that detects inorganic ions by, e.g., adsorptive stripping voltammetry and potentiometric stripping analysis. It will be apparent to those skilled in the art that multiple types of chemical sensors may be used so that the polishing media includes the chemical sensors best suited for detecting the expected effluent materials, e.g., ionic species, organic species, and inorganic species.

During a CMP operation, the feedback received from chemical sensors 106'*d* can be used in a process control scheme to call an end point of the CMP operation. By way of example, the end point may be called when chemical sensors 106'*d* detect the transition from Cu to Ta as shown in FIGS. 4A-1 and 4A-2. The feedback received from chemical sensors 106'*d* also can be used to determine when to transition to different process control settings and when to introduce new process chemistry.

Figure 5:
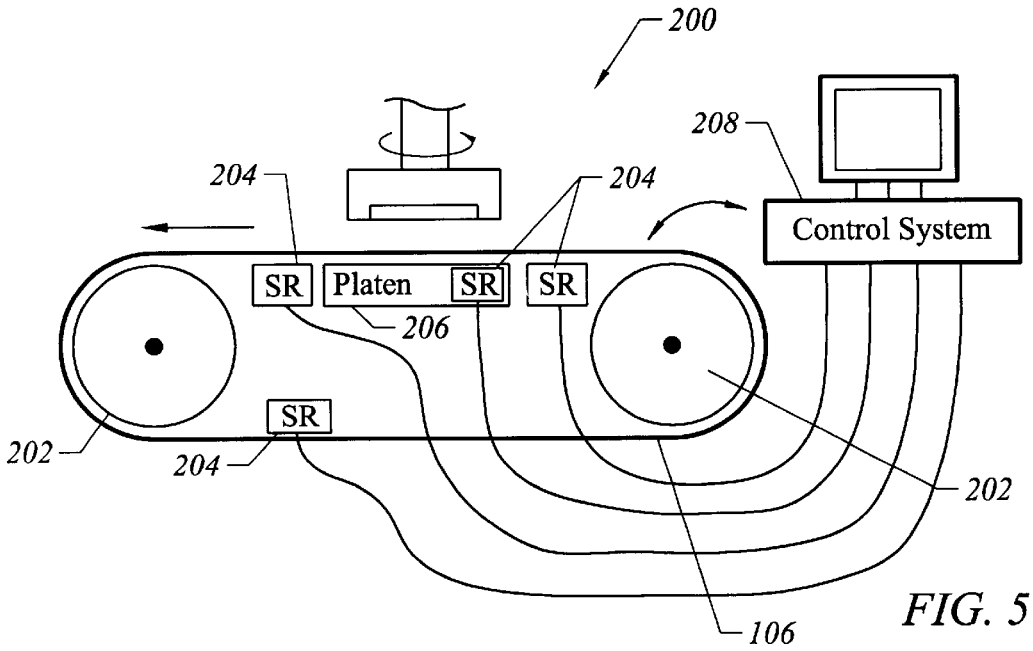
FIG. 5 is a schematic diagram of a linear CMP system in which the sensors provided on a polishing media are in sensory communication with a control system in accordance with one embodiment of the present invention.

FIG. 5 is a schematic diagram of a linear CMP system in which the sensors provided on a polishing media are in sensory communication with a control system in accordance with one embodiment of the present invention. As shown in FIG. 5, linear CMP system 200 includes pad-belt 106, which rotates around drums 202 as is well known to those skilled in the art. Sensory receivers 204 are provided to communicate with the sensors provided on pad-belt 106 using a suitable wireless communication standard, e.g., Bluetooth. Sensory receivers 204, which are coupled to control system 208, may be disposed at any suitable location for communicating with the sensors provided on padbelt 106, e.g., underneath the top plane of the pad-belt, above the bottom plane of the padbelt, or within platen 206. As shown in FIG. 5, sensory receivers 204 are hard wired to control system 208. Alternatively, sensory receivers 204 may communicate with control system 208 using a suitable wireless communication standard, e.g., Bluetooth. In operation, sensory receivers 204 collect information from the sensors provided on pad-belt 106 and communicate this information to control system 208. As described above, control system 208 can use the information from the sensors to call the end point of a CMP operation, to determine when to transition to different process settings, and to determine when to introduce new process chemistry. It will be apparent to those skilled in the art that non-wireless communication protocols for hard-platen rotary based CMP process tools may be used.

Figure 6:
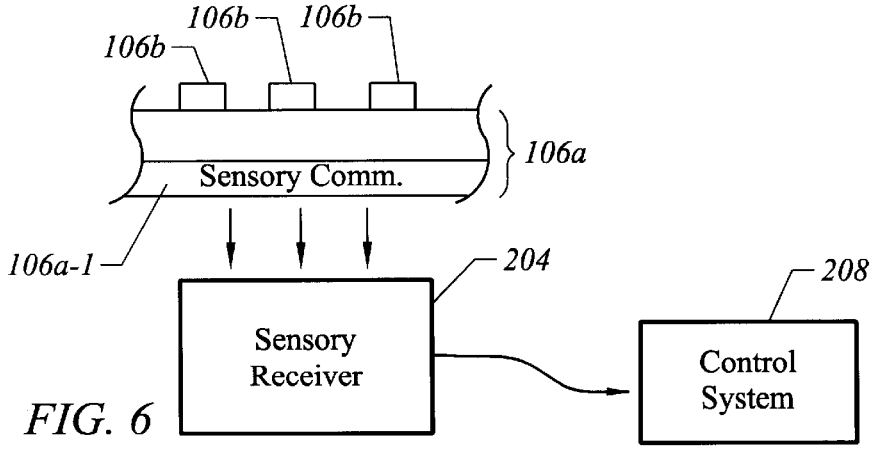
FIG. 6 is a schematic diagram that illustrates how the sensors provided on the pad-belt communicate with the control system via the sensory receivers.

FIG. 6 is a schematic diagram that illustrates how the sensors provided on the pad-belt communicate with the control system via the sensory receivers. As shown therein, underlayer 106*a* of pad-belt 106 includes a bottom level 106*a*-1 having inlaid wiring for sensory communication with control system 208. The inlaid wiring enables the sensors provided on pad-belt 106 to communicate with sensory receivers 204, which in turn relay the information to control system 208.

The construction of the polishing media, e.g., pad or pad-belt, can be tailored to provide the partitioning of pad asperities to desired densities and surface area coverage corresponding to die-level and wafer-level topography variations imposed by specific process applications, e.g., STI, Cu metal level, etc. As described above, the pad construction includes multiple levels. In one embodiment, the pad construction includes a top level, an intermediate level, and a bottom level. The top level includes pad asperities for contacting the wafer substrate, e.g., pad asperities 106*b* shown in, e.g., FIGS. 1A–1C. The pad asperities may be formed of standard urethane-based materials, e.g., polyurethane, that have been machined using computer numeric control (CNC) machining techniques. Alternatively, the pad asperities may be formed of micro machined substrates having desired surface/bulk material properties. The intermediate level includes sensors, e.g., pressure sensors and chemical sensors, as described in detail above. The sensors may be affixed, e.g., laminated, to the bases of the pad asperities or embedded in the underlayer. The bottom level, which is referred to herein as the underlayer, provides both macro pad deformation behavior (optimized bulk modulus to provide a desired level of pad/substrate conformance) and inlaid wiring to provide sensory communication to a process control system. By way of example, the bottom level may be formed of standard urethane-based materials, e.g., polyurethane, pressure sensitive adhesives (PSAs), laminates, and engineered plastics. It will be apparent to those skilled in the art that the polishing media may include additional levels, e.g., a stainless steel backing.

Figure 7:
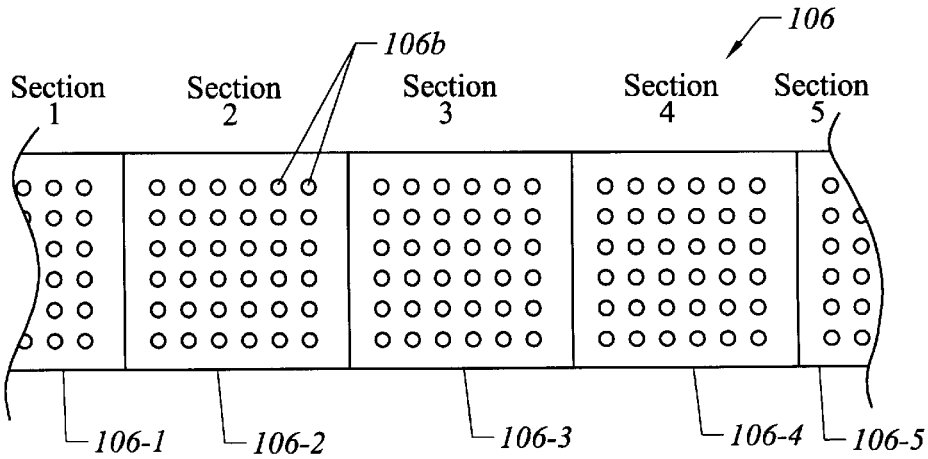
FIG. 7 is a simplified top, partial view of a polishing pad formed in discrete sections.
Figure 8:
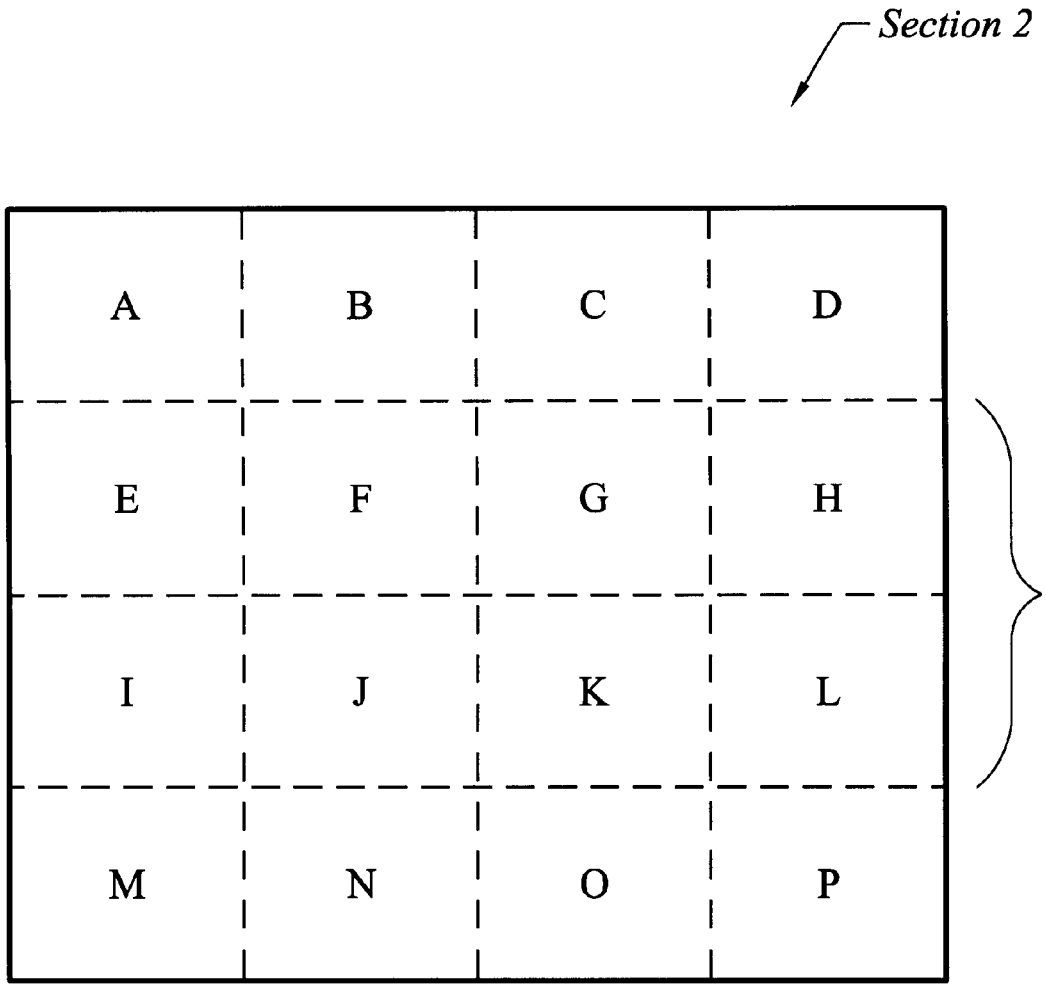
FIG. 8 is an enlarged view of one section of the polishing pad shown in FIG. 7.

It may be desirable to form the polishing media in discrete sections to enable selected partial replacement of desired sections, e.g., sections subjected to excess wear. FIG. 7 is a simplified top, partial view of a polishing pad formed in discrete sections. As shown therein, polishing pad 106 includes discrete sections 106-1, 106-2, 106-3, 106-4, and 106-5. In the event one of the sections is damaged or subjected to excess wear, that section can be individually replaced. This is advantageous because it avoids the need to replace the entire polishing pad. FIG. 8 is an enlarged view of section 106-2 (section 2) shown in FIG. 7. As shown in FIG. 8, section 106-2 is divided into quadrants A to P. Each of quadrants A to P may be provided with a desired density of pad asperities disposed on top of sensors. To minimize processing requirements, the sensors within each quadrant can be treated, e.g., as a single sensor or a number of sensors selected to provide a desired amount of processing granularity. Alternatively, in the case of a padbelt for linear CMP, rows or columns of sensors can be treated as a single sensor to minimize processing requirements.

Figures 9A, 9B:
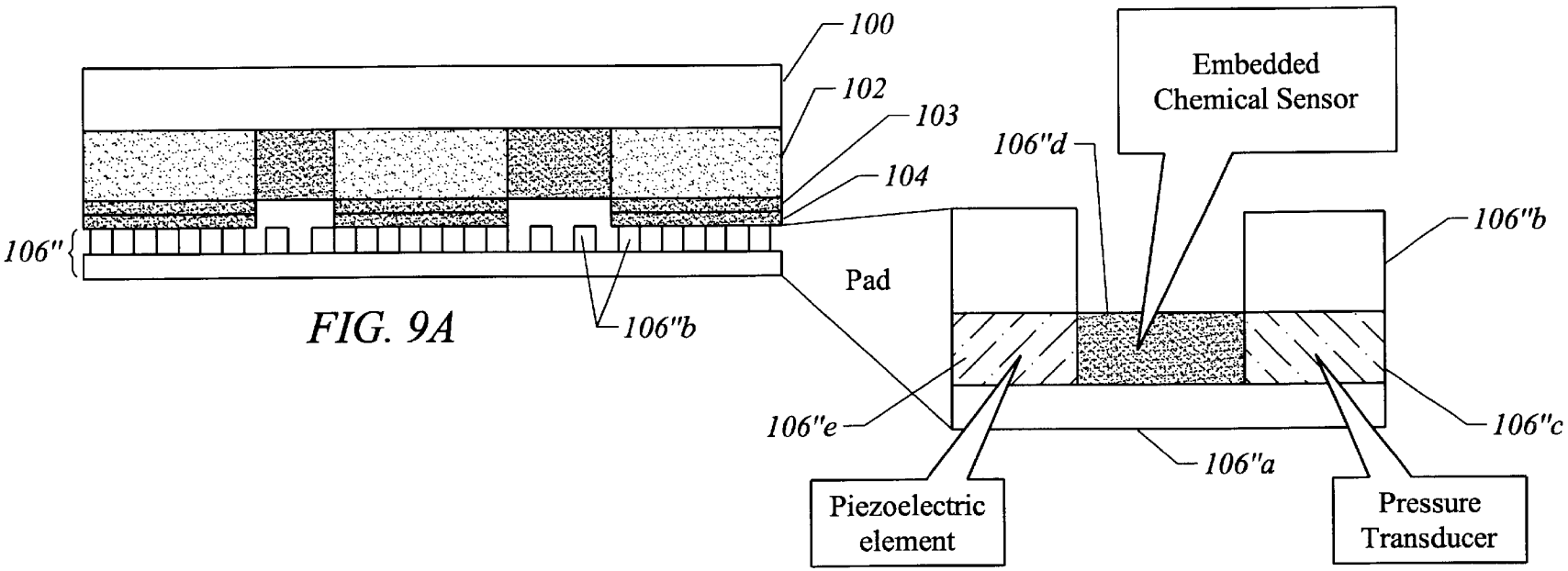
FIGS. 9A and 9B show the structure of a polishing media configured to implement an active control scheme in accordance with one embodiment of the invention, with FIG. 9B being an enlarged view of the portion of the polishing media indicated in FIG. 9A.

The linear CMP system shown in FIG. 5 implements a passive scheme in which the information from the sensors is collected and reported to the process control system. If desired, the sensors provided on the polishing media can be used to implement active control of the process input. FIGS. 9A and 9B show the structure of a polishing media configured to implement an active control scheme in accordance with one embodiment of the invention, with FIG. 9B being an enlarged view of the portion of the polishing media indicated in FIG. 9A. As shown in FIG. 9B, underlayer 106"*a* has pressure sensor 106"*c*, chemical sensor 106"*d*, and piezoelectric element 106"*e* provided thereon. Each of pressure sensor 106"*c* and piezoelectric element 106"*e* has pad asperity 106"*b* provided thereon. Piezoelectric element 106"*e* is coupled to one or both of the sensory outputs of pressure sensor 106"*c* and chemical sensor 106"*d*. Based upon the sensory outputs received from the adjacent sensors, piezoelectric element 106"*e* will actively modify the removal rate behavior. By way of example, piezoelectric element 106"*e* may provide localized vibration to modify the spatial removal behavior. Alternatively, piezoelectric element 106"*e* may induce either localized electric fields or localized heating/cooling elements provided on the polishing media. In this manner, the piezoelectric elements provide active control to the process input.

In summary, the present invention provides an afferent-based polishing media for CMP. The invention has been described herein in terms of several exemplary embodiments. Other embodiments of the invention will be apparent to those skilled in the art from consideration of the specification and practice of the invention. By way of example, the pressure sensors or thermal actuators may be provided in the carrier film instead of the polishing pad. The embodiments and preferred features described above should be considered exemplary, with the invention being defined by the appended claims and equivalents thereof.

What is claimed is:

1. A polishing media for chemical mechanical planarization, comprising:

an underlayer;

a plurality of pressure sensors provided on the underlayer, at least some of the pressure sensors having a pad asperity provided thereon;

a plurality of chemical sensors provided on the underlayer; and a plurality of piezoelectric elements provided on the underlayer, each of the piezoelectric elements being coupled to at least one of an adjacent pressure sensor and an adjacent chemical sensor.

2. The polishing media of claim 1, wherein at least some of the piezoelectric elements provide localized vibration.

3. The polishing media of claim 1, wherein at least some of the piezoelectric elements induce localized electric fields.

4. The polishing media of claim 1, wherein at least some of the piezoelectric elements induce localized heating/cooling elements.

5. The polishing media of claim 1, wherein at least some of the piezoelectric elements have a pad asperity provided thereon.

6. The polishing media of claim 1, wherein the underlayer is formed in discrete sections.

7. The polishing media of claim 1, wherein the pressure sensors are micro electro-mechanical systems (MEMS) pressure transducers.

8. The polishing media of claim 1, wherein the pressure sensors are micro electro-mechanical systems (MEMS) thermal actuators that monitor at least one of localized strain and temperature variation.

9. The polishing media of claim 1, wherein the pad asperities are comprised of one of a urethane-based material, an engineered plastic material, a ceramic material, a magnetic fluid material, and a MEMS construction material.

10. The polishing media of claim 1, wherein at least some of the chemical sensors are configured to detect metal ions selected from the group consisting of Cu, Ta, Ti, Al, W, and Pb.

11. The polishing media of claim 1, wherein at least some of the chemical sensors are configured to detect organic species.

12. The polishing media of claim 1, wherein at least some of the chemical sensors are configured to detect inorganic species.

* * * * *